US010416592B2

(12) United States Patent
Terada

(10) Patent No.: US 10,416,592 B2
(45) Date of Patent: Sep. 17, 2019

(54) DEVELOPMENT DEVICE FOR AN ELECTROSTATIC LATENT IMAGE

(71) Applicant: CANON KABUSHIKI KAISHA, Tokyo (JP)

(72) Inventor: Ryohei Terada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/366,834

(22) Filed: Mar. 27, 2019

(65) Prior Publication Data

US 2019/0219950 A1 Jul. 18, 2019

Related U.S. Application Data

(63) Continuation of application No. 15/913,555, filed on Mar. 6, 2018, now Pat. No. 10,289,030.

(30) Foreign Application Priority Data

Mar. 16, 2017 (JP) ..... 2017-051250

(51) Int. Cl.

| | |
|---|---|
| ***G03G 15/08*** | (2006.01) |
| ***G03G 15/06*** | (2006.01) |
| ***G03G 15/09*** | (2006.01) |

(52) U.S. Cl.

CPC ..... *G03G 15/0896* (2013.01); *G03G 15/065* (2013.01); *G03G 15/0921* (2013.01); *G03G 2215/0651* (2013.01)

(58) Field of Classification Search

CPC ..... G03G 15/0896; G03G 15/0921; G03G 15/065; G03G 2215/0651

See application file for complete search history.

(56) References Cited

U.S. PATENT DOCUMENTS

| | | | | |
|---|---|---|---|---|
| 4,363,861 | A * | 12/1982 | Nakamura | G03G 13/09 204/DIG. 8 |
| 4,444,864 | A * | 4/1984 | Takahashi | G03G 15/065 399/314 |
| 5,428,428 | A * | 6/1995 | Haneda | G03G 15/0803 399/276 |
| 5,464,720 | A * | 11/1995 | Baba | G03G 9/0819 399/271 |
| 5,473,416 | A * | 12/1995 | Endou | G03G 15/0803 399/265 |
| 2013/0236215 | A1* | 9/2013 | Ochi | G03G 15/0189 399/269 |
| 2017/0248871 | A1* | 8/2017 | Iwatsuki | G03G 15/0907 |

* cited by examiner

*Primary Examiner* — Francis C Gray

(74) *Attorney, Agent, or Firm* — Canon U.S.A., Inc. IP Division

(57) ABSTRACT

A development device includes a power source capable of applying a second voltage higher than a first voltage to be applied to a developer bearing member, a scattering prevention electrode that is arranged opposite the developer bearing member and to which the second voltage is applied from the power source, and a step-down circuit. The step-down circuit steps down a voltage from the power source from the second voltage to the first voltage to apply the stepped-down voltage to the developer bearing member.

7 Claims, 13 Drawing Sheets

FIG.10

| | COMPARATIVE EXAMPLE | FIRST EXEMPLARY EMBODIMENT | SECOND EXEMPLARY EMBODIMENT |
|---|---|---|---|
| ELECTRODE POWER SOURCE | PRESENT | ABSENT | ABSENT |
| STAIN ON IMAGE | ○ | ○ | ○ |
| STAIN ON DEVELOPMENT DEVICE | ○ | ○ | ○ |
| STAIN ON TRANSFER UNIT | ○ | ○ | ○ |
| STAIN ON EXPOSURE UNIT | △ | △ | ○ |

DEVELOPMENT DEVICE FOR AN ELECTROSTATIC LATENT IMAGE

CROSS-REFERENCE TO RELATED APPLICATION

This application is a Continuation of U.S. application Ser. No. 15/913,555, filed Mar. 6, 2018, which claims priority from Japanese Patent Application No. 2017-051250, filed Mar. 16, 2017, all of which are hereby incorporated by reference herein in their entirety.

BACKGROUND

Field of the Disclosure

The present disclosure relates to a development device that develops an electrostatic latent image with developer and to an image forming apparatus.

Description of the Related Art

Electrophotographic image forming apparatuses such as laser printers and laser multifunction apparatuses used in offices or on-demand convenience printing generally form images by the following processes.

That is, after a surface of a photosensitive member is uniformly charged, the surface of the photosensitive member is irradiated using a laser or a light emitting diode (LED) according to image information input from, for example, a personal computer (PC). In the irradiated region, an electric charge generated inside the photoconductor cancels the charge, so that an electrostatic latent image according to the image information is formed on the surface of the photosensitive member. A development device visualizes such an electrostatic latent image as a toner image by electrostatically attaching toner of coloring resin to the electrostatic latent image. The developed toner image is transferred to a recording medium such as a sheet by a transfer device via an intermediate transfer member. The toner image transferred to the recording medium is melted and fixed on the recording medium by a fixing device using heat and pressure, thereby providing a final output product. After the transfer operation, a residual toner on the photoconductor is cleaned by a cleaning device, whereas a residual electric charge on the photoconductor is removed by a discharging device, so that the photosensitive member becomes ready for next image forming process.

Meanwhile, the image forming apparatuses have been expected to accelerate output of images and enhance image quality. At the same time, simplification of maintenance work on the image forming apparatuses is expected. Reduction of toner soiling inside the image forming apparatus is one example of the maintenance simplification. The inside of the image forming apparatus may be soiled with toner. In such a case, the soiling causes a failure such as a stain on an output image, and cleaning becomes necessary at replacement of a development unit or a photoconductive drum unit. Moreover, toner may adhere to each drive unit. In such a case, slippage occurs. This may cause the drive unit not to perform a drive operation with accuracy.

Herein, toner scattering is one of the causes of the toner soiling inside the image forming apparatus. The toner scattering is a problem in which toner is scattered from the inside of the development device. Thus, the following countermeasure has been conventionally proposed to deal with the toner scattering (Japanese Patent Application Laid-Open No. 8-171282). Voltage is applied to an air discharge path provided from the inside of a development device, so that charged toner is removed from the discharging air according to the technique discussed in Japanese Patent Application Laid-Open No. 8-171282. In the development device discussed in Japanese Patent Application Laid-Open No. 8-171282, a conductive member is arranged opposite a development sleeve, and a power source applies, to the conductive member, voltage having the same polarity as a triboelectric charge polarity of developer. This generates a potential difference between the conductive member and the development sleeve, and the toner is pressed toward a development sleeve direction to remove the toner from the discharging air. As a result, the toner scattering is effectively prevented.

The application of voltage to the air discharge path of the development device can effectively remove the scattered toner. However, the application of voltage to the conductive member requires a power source other than a power source for applying a development voltage, thus causing an increase in costs.

SUMMARY

The present disclosure is directed to an image forming apparatus, wherein the image forming apparatus is able to execute image formation, comprising.

Accordingly, the present disclosure provides, an image forming apparatus, comprising, an image bearing member; a developing device including: a developer container configured to accommodate the developer including a toner and a carrier; a rotatable developing member configured to carry and feed the developer toward a position where an electrostatic image formed onto the image bearing member is developed; a magnet fixedly arranged inside the rotatable developing member, including a plurality of magnetic poles, and configured to generate a magnetic field for separating the developer that has passed the position where the electrostatic image formed onto the image bearing member is developed from an outer circumferential surface of the rotatable developing member, the plurality of magnetic poles including: a first magnetic pole arranged closest to the position where the electrostatic image formed onto the image bearing member is developed, a second magnetic pole arranged downstream of the first magnetic pole with respect to a rotational direction of the rotatable developing member, a third magnetic pole arranged upstream of the first magnetic pole and downstream of the second magnetic pole with respect to the rotational direction of the rotatable developing member so as to be adjacent to the second magnetic field, and having a same polarity as the second magnetic pole, and a plate-like electrode stationary attached to the developer container, the plate-like electrode arranged downstream of the position where the electrostatic image formed onto the image bearing member is developed and upstream of the second magnetic pole with respect to the rotational direction of the rotatable developing member so as to face the outer circumferential surface of the rotatable developing member; wherein, during the image formation, only a first direct-current voltage is applied to the plate-like electrode and only a second direct-current voltage is applied to the rotatable developing member so that the first direct-current voltage applied to the plate-like electrode has a same polarity as a normal charge polarity of the toner, the second direct-current voltage applied to the rotatable developing member has a same polarity as the normal charge polarity of the toner, and an absolute value of the first direct-current voltage applied to the plate-like electrode is greater than an absolute value of the second direct-current voltage applied to the rotatable developing member.

Further features of the present disclosure will become apparent from the following description of exemplary embodiments with reference to the attached drawings.

BRIEF DESCRIPTION OF THE DRAWINGS

FIG. 10 is a diagram illustrating results of verification experiments, according to one or more embodiment(s) of the subject disclosure.

DESCRIPTION OF THE EMBODIMENTS (Configuration of Printer)

Figure 1:
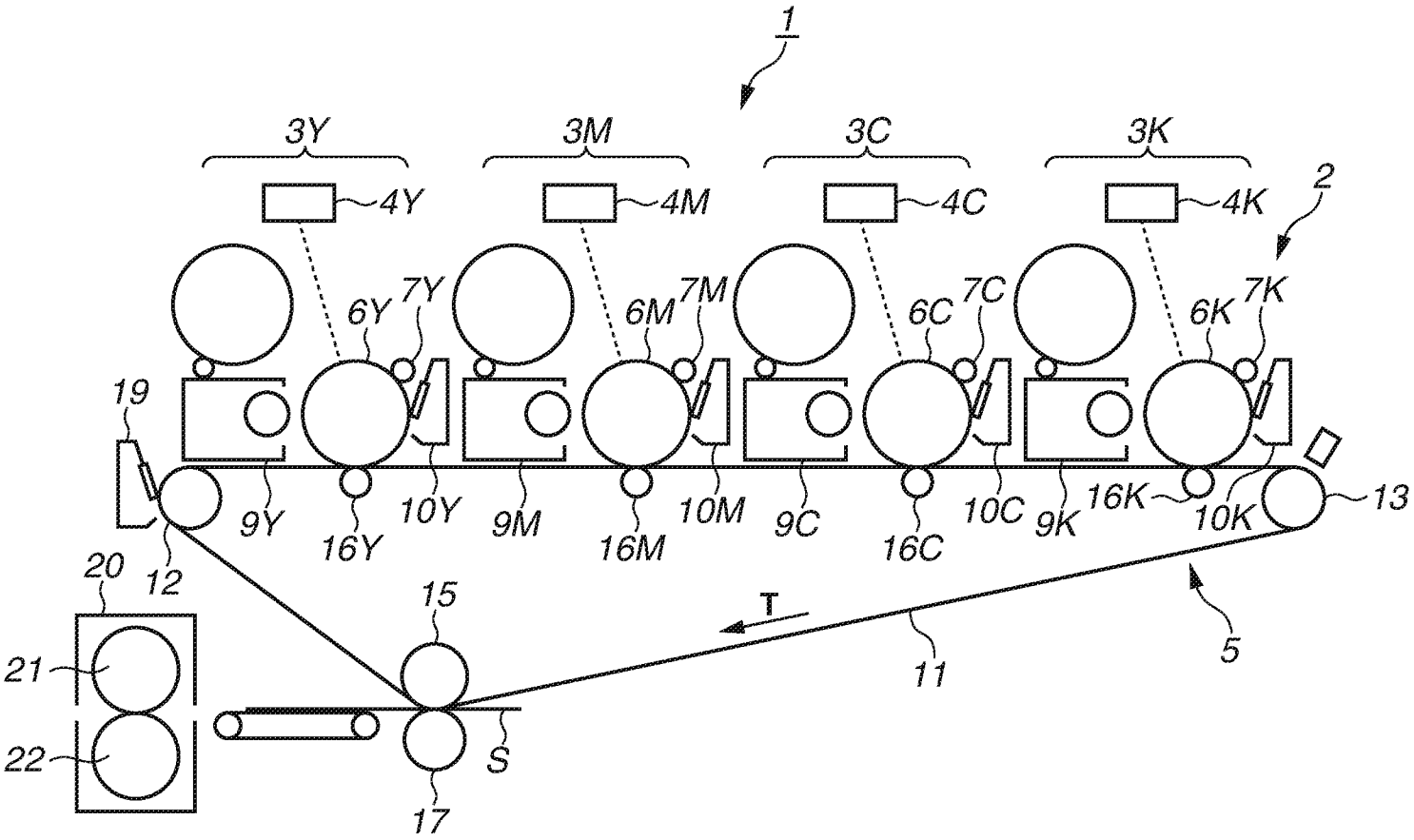
FIG. 1 is a schematic diagram illustrating an image forming apparatus according to a first exemplary embodiment.

A first exemplary embodiment is hereinafter described. A full-color laser printer (printer) 1 as an image forming apparatus of the present exemplary embodiment is described with reference to the drawings. The printer 1 is an electrophotographic color laser beam printer for forming an image according to signals from an information terminal such as a personal computer (PC) to output the image. The printer 1 employs a two-component contact development method. Specifically, the printer 1 as illustrated in FIG. 1 includes an image forming unit 2 that forms an image on a sheet (a recording medium) fed from a sheet feeding unit (not illustrated). The image forming unit 2 includes process cartridges 3Y, 3M, 3C, and 3K for yellow (Y), magenta (M), cyan (C), and black (K), exposure devices 4Y, 4M, 4C, and 4K respectively arranged in the process cartridges 3Y, 3M, 3C, and 3K, and an intermediate transfer unit 5. The process cartridges 3Y, 3M, 3C, and 3K are arranged in the order of yellow, magenta, cyan, and black along an intermediate transfer belt 11 as an intermediate transfer member. Since configurations of the process cartridges 3Y, 3M, 3C, and 3K are basically similar to one another except for the color of toner stored therein, only the configuration of the yellow process cartridge 3Y is hereinafter described as a representative of the process cartridges 3Y, 3M, 3C, and 3K.

The process cartridge 3Y includes a photosensitive drum 6Y. Moreover, the process cartridge 3Y includes a charging device 7Y, a development device 9Y, and a drum cleaning device 10Y that are arranged around the photosensitive drum 6Y. The photosensitive drum 6Y has a surface that is to be uniformly charged with potential by the charging device 7Y. The negatively charged surface of the photosensitive drum 6Y is irradiated with laser beams or LED light from the exposure device 4Y based on signals of image information, so that an electrostatic latent image is formed on the surface. Subsequently, the development device 9Y develops the electrostatic latent image formed on the surface of the photosensitive drum 6Y, thereby forming a toner image.

The intermediate transfer unit 5 includes the intermediate transfer belt 11, a drive roller 12, a tension roller 13, a secondary transfer inner roller 15, and a primary transfer rollers 16Y, 16M, 16C, and 16K. The intermediate transfer belt 11 is stretched around these rollers. The primary transfer rollers 16Y, 16M, 16C, and 16K are arranged opposite the respective photosensitive drums 6Y, 6M, 6C, and 6K for yellow, magenta, cyan, and black with the intermediate transfer belt 11 therebetween, and form primary transfer portions with the respective photosensitive drums 6Y, 6M, 6C, and 6K. Accordingly, toner images of respective colors formed on the photosensitive drums 6Y, 6M, 6C, and 6K are respectively transferred in the primary transfer portions so as to be superimposed one on another, so that a full-color toner image is formed on the intermediate transfer belt 11. In the present exemplary embodiment, the intermediate transfer belt 11 is driven in a direction indicated by an arrow T illustrated in FIG. 1 by the drive roller 12, and the toner images of respective colors are transferred to the intermediate transfer belt 11 in the order of yellow, magenta, cyan, and black.

The secondary transfer inner roller 15 is arranged on a downstream side of the primary transfer portions in a rotational direction of the intermediate transfer belt 11. The secondary transfer inner roller 15 forms a secondary transfer portion with a secondary transfer outer roller 17 that is arranged opposite the secondary transfer inner roller 15 with the intermediate transfer belt 11 therebetween. A sheet S is conveyed to the secondary transfer portion in time with the full color toner image formed on the intermediate transfer belt 11, and a transfer bias is applied to the secondary transfer outer roller 17, so that the full-color toner image is transferred onto the sheet S. A residual toner remaining on the intermediate transfer belt 11 is cleaned by a belt cleaning device 19.

A fixing device 20 is arranged on a downstream side of the secondary transfer portion. The fixing device 20 fixes an unfixed toner image transferred onto the sheet S on the sheet S. The fixing device 20 is configured such that a heating nip is formed by a heating roller 21 including a halogen heater thereinside and a counter roller 22 arranged opposite the heating roller 21. In the heating nip, the unfixed toner image is fixed on the sheet S with pressure and heat.

<Development Device>

Next, a configuration of the development device 9Y is described in detail with reference to FIGS. 2 and 3. In a two-component development method, two-component developer containing toner of coloring resin and carrier of magnetic particles is used as developer. The toner and the carrier in the two-component developer are mixed at a certain ratio. In the course of development, such developer is conveyed to a development region 23 in which the development device 9Y and the photosensitive drum 6Y become close to and opposite each other, and only the toner adheres to an electrostatic latent image on a surface of the photosensitive drum 6Y. This forms a toner image, and the electrostatic latent image is visualized.

Figure 2:
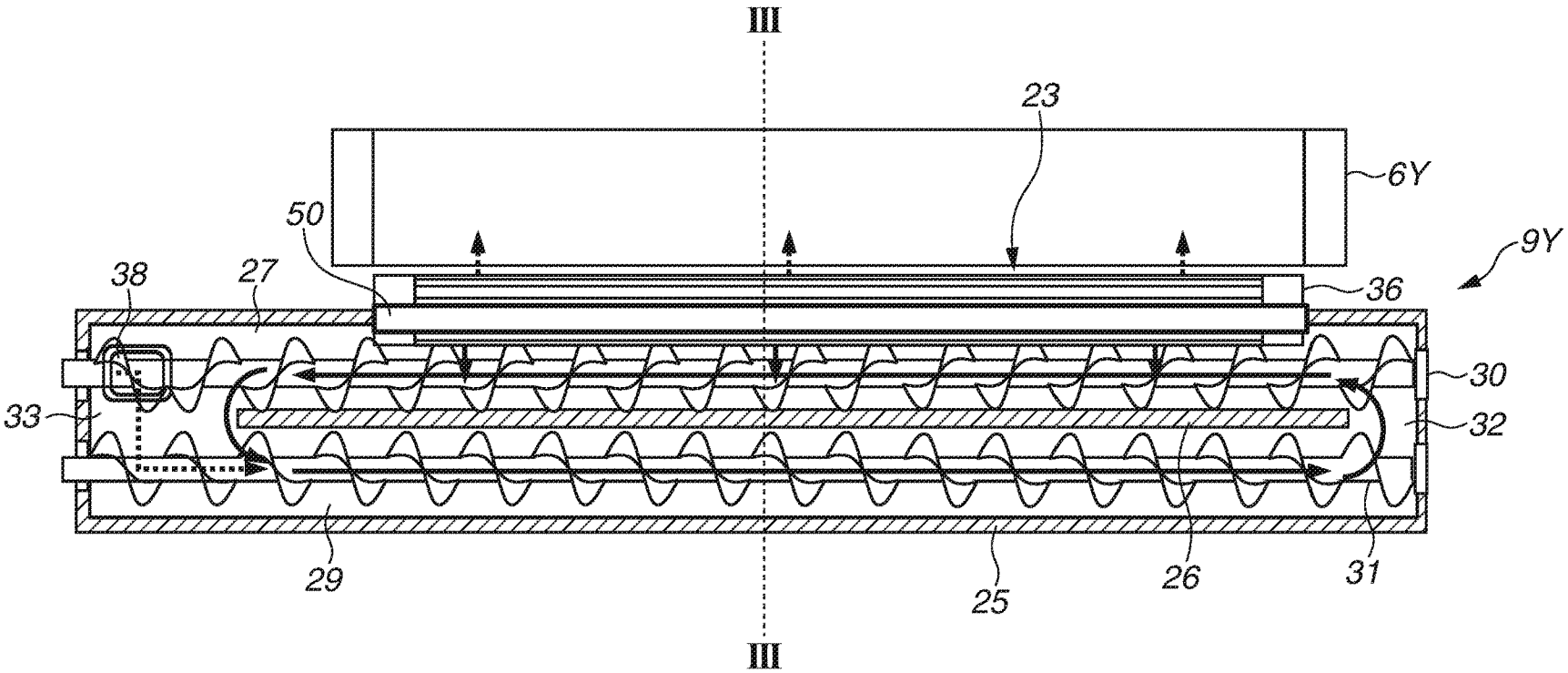
FIG. 2 is a sectional view illustrating a longitudinal section a development device, according to one or more embodiment(s) of the subject disclosure.
Figure 3:
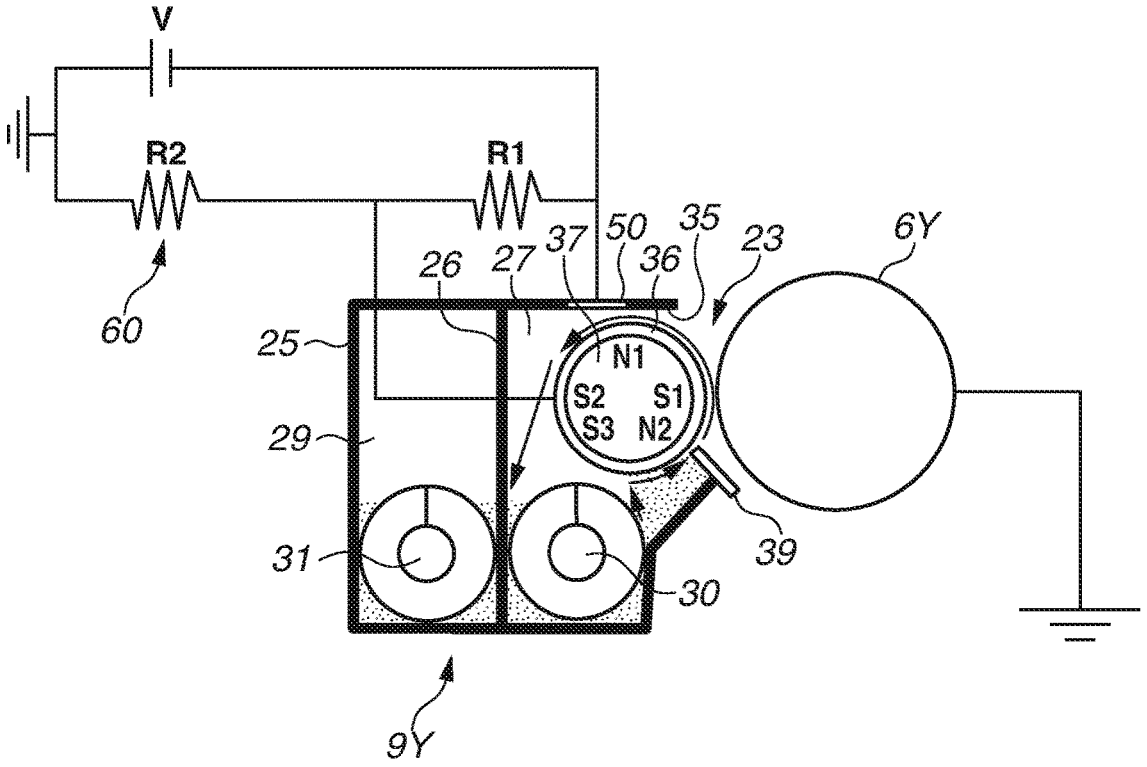
FIG. 3 is a sectional view along the line III-III of FIG. 2, according to one or more embodiment(s) of the subject disclosure.

The development device 9Y, as illustrated in FIGS. 2 and 3, includes a developer container 25 in which the developer is stored. The developer container 25 includes a development chamber 27 and an agitation chamber 29 that are partitioned by a partition wall 26 extending in a substantially middle portion thereinside. Moreover, the development chamber 27 includes a first conveyance screw 30, whereas the agitation chamber 29 includes a second conveyance screw 31 arranged opposite the first conveyance screw 30. The first and second conveyance screws 30 and 31 are rotatably arranged. Each of the first and second conveyance screws 30 and 31 has a shape with a helical blade wound around a rotation shaft, and the rotation shaft and a helical blade shape are appropriately set according to screw performance.

Moreover, each of the first and second conveyance screws 30 and 31 rotates when the rotation shaft is driven by a drive source positioned outside the development device 9Y, and conveys developer in a predetermined constant direction while agitating the developer. Each of the first and second conveyance screws 30 and 31 is arranged so as to convey the developer in an inverse direction.

Moreover, first and second communication ports 32 and 33 through which the development chamber 27 and the agitation chamber 29 communicate with each other are arranged on both respective ends of the partition wall 26 of the developer container 25. Specifically, the first communication port 32 is positioned on an upstream side in a conveyance direction of the first conveyance screw 30 of the development chamber 27 and in the vicinity of an end portion of the partition wall 26 on a downstream side in a conveyance direction of the second conveyance screw 31 of the agitation chamber 29. The second communication port 33 is positioned on a downstream side in the conveyance direction of the first conveyance screw 30 of the development chamber 27 and in the vicinity of an end portion of the partition wall 26 on an upstream side in the conveyance direction of the second conveyance screw 31 of the agitation chamber 29. Accordingly, the developer conveyed by the first conveyance screw 30 is delivered to the counter screw, i.e., the second conveyance screw 31, via the second communication port 33, whereas the developer conveyed by the second conveyance screw 31 is delivered to the counter screw, i.e., the first conveyance screw 30, via the first communication port 32. Hence, the developer circulates between the development chamber 27 and the agitation chamber 29 so as to rotate in a constant direction.

Moreover, an opening 35 is arranged in a position above the development chamber 27 in the developer container and opposite the photosensitive drum 6Y, and a development sleeve 36 is arranged such that one portion thereof is exposed to the outside of the developer container 25 via the opening 35. The development sleeve 36 conveys developer from the development chamber 27 inside the developer container 25 to the development region 23 via the opening 35. That is, the development sleeve 36 as a developer bearing member is not only arranged such that one portion thereof is exposed from the opening 35 of the developer container 25, but also bears and conveys the developer inside the developer container 25 to develop an electrostatic latent image on the image bearing member.

Next, a configuration of the development sleeve 36 is described in detail. The above-described development sleeve 36 is made of non-magnetic metal and has a cylindrical structure. The development sleeve 36 is arranged to face the opening 35 of the developer container in a state in which the development sleeve 36 is rotatable. The development sleeve 36 has a surface that is processed (e.g., blasting process and knurling process) to enhance developer conveying property. The development sleeve 36 conveys developer by a friction force. Moreover, a non-rotatable magnet roller (a magnetic field generation member) 37 having five magnetic poles is arranged inside the development sleeve 36. The development sleeve 36 uses the magnetic poles of the magnet roller 37 to bear and peel the developer.

Next, the magnetic poles of the magnet roller 37 and functions of the magnetic poles according to movement of the developer borne and conveyed by the development sleeve 36 are described. The developer agitated and conveyed in the development chamber 27 is borne by the development sleeve 36 by a magnetic force of a draw-up pole S3. The rotation of the development sleeve 36 conveys the developer borne by the development sleeve 36 to the vicinity of a cut pole N2 positioned on a downstream side of the draw-up pole S3. The developer in the vicinity of a magnetic pole of the magnet roller 37 enters a state of a magnetic brush in which carrier is aligned in a chain manner according to a magnetic line of force generated by the magnetic pole of the magnet roller 37. Repulsive force acts on each of the magnetic brushes, and a predetermined distance or more is kept between the magnetic brushes by the repulsive force. In such a state of the magnetic brush according to the magnetic line of force, the developer passes a gap between the development sleeve 36 and a development blade 39 substantially opposite the cut pole N2. Thus, a height of the magnetic brush is restricted, and a layer of the developer on the development sleeve 36 is thinned, thereby regulating an amount of the developer to be conveyed.

The developer the flow volume of which is regulated at the cut pole N2 passes the opening 35 of the developer container 25, and then is exposed to the outside of the developer container 25. Moreover, the rotation of the development sleeve 36 delivers the developer to a position of a development pole S1 substantially opposite the development region 23 of the photosensitive drum 6Y. In the development region 23, only toner in the developer is ejected to the electrostatic latent image on the photosensitive drum 6Y by an electrostatic force to develop the electrostatic latent image. Herein, a negative direct current voltage as a development voltage is applied to the development sleeve 36 to use the electrostatic force. A voltage in which an alternating current voltage is superimposed on a negative direct current voltage can be applied as development voltage.

Since a region of the photosensitive drum 6Y in which toner is to be provided has a potential more positive than a direct current voltage by exposure, application of a development voltage to the development sleeve 36 causes negatively charged toner to be ejected toward the photosensitive drum 6Y. Moreover, a region to which toner is not to be provided is set to have a potential more negative than the direct current voltage, so that toner can remain without ejection. Therefore, toner can be selectively ejected to an electrostatic latent image on the photosensitive drum 6Y to develop the electrostatic latent image. Herein, since the carrier is attracted toward the development sleeve 36 by a magnetic force of the development pole S1 and the electrostatic force, the carrier remains on a surface of the development sleeve 36 without ejection.

After the development, the developer is conveyed by a magnetic force of a conveyance pole N1 while remaining borne on the development sleeve 36. In the vicinity of the conveyance pole N1, the developer passes the opening 35 of the developer container 25 again and is taken into the developer container 25. An opening portion from which the developer on the development sleeve 36 is taken into the developer container 25 is referred to as an intake 40 (see FIG. 4). The developer taken into the developer container while being conveyed by the conveyance pole N1 is conveyed to a stripping pole S2. The stripping pole S2 has the same polarity as a polarity of the draw-up pole S3, and a repulsive force is generated between the stripping pole S2 and the draw-up pole S3. On a downstream side of the stripping pole S2, the developer receives a magnetic force in a reverse direction with respect to a rotational direction of the development sleeve 36 due to the repulsive force. The rotation of the developer is stopped due to the magnetic force in the reverse direction with respect to the rotational direction of the development sleeve 36, and the developer is retained in a retention portion from the stripping pole S2 to the vicinity of the downstream side of the stripping pole S2. Herein, the developer retention portion is referred to as a stripping retention portion. A maximum retention amount in the developer retention portion is determined by a magnetic force of the stripping pole S2 and other. However, since the developer is constantly supplied from an upstream side of the development sleeve 36 to the stripping retention portion, a retention amount of the developer exceeds the maximum retention amount at some point in time. Developer that is supplied beyond the maximum retention amount cannot be borne by the development sleeve 36, and thus drops. The developer which has dropped is collected in the development chamber 27, and then is again agitated and conveyed in the development chamber 27. Such a process is repeated, so that the development device 9Y supplies the toner to the photosensitive drum 6Y to develop an electrostatic latent image into a toner image.

After the development, a toner density of the developer is lowered since the toner is consumed by an amount corresponding to an output image formed by the printer 1 as an image forming apparatus. Such developer having a lower toner density returns to the development chamber 27, and then circulates inside the developer container 25 again. Accordingly, the circulation developer needs to be replenished with toner by an amount equal to the amount of toner consumed for the output image to maintain a toner density of the developer circulating inside the developer container 25. Accordingly, the developer container 25 includes a toner cartridge attached to a replenishment port 38 that is used to replenish the consumed amount of toner, and toner inside the toner cartridge is supplied to a developer circulation path via the replenishment port 38.

<Air Current in Vicinity of Development Sleeve>

Figure 4:
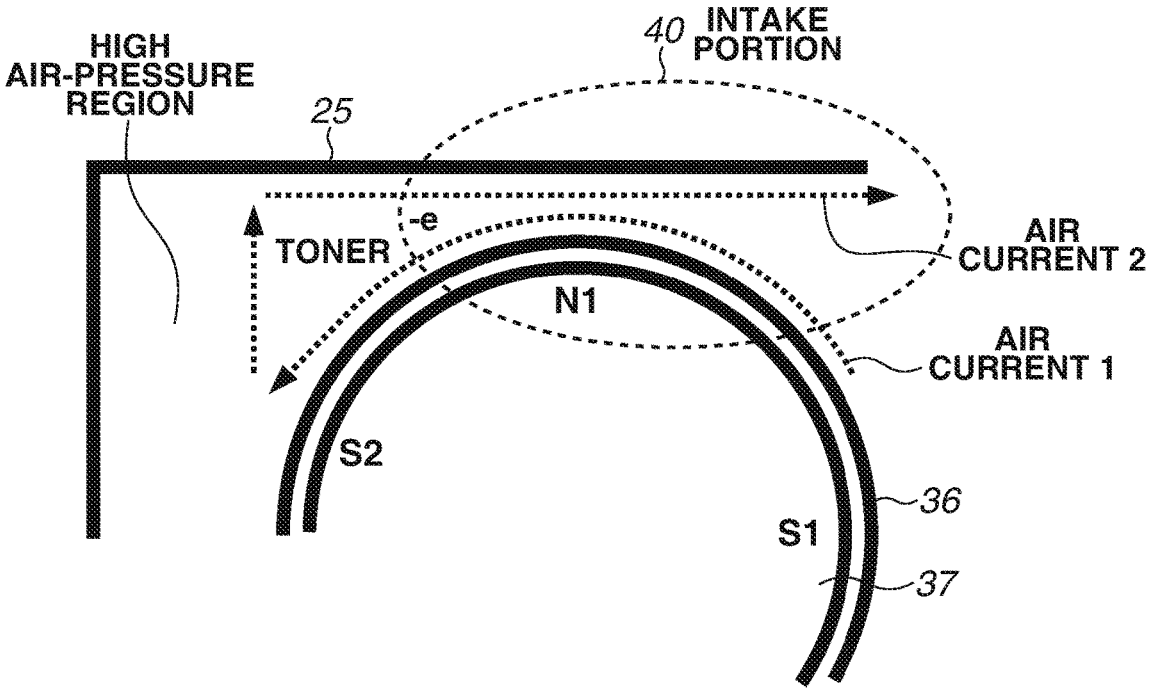
FIG. 4 is a schematic diagram illustrating an air current in the vicinity of a developer bearing member, according to one or more embodiment(s) of the subject disclosure.

Generation of an air current in the vicinity of the development sleeve 36 is described with reference to FIG. 4. Basically, the rotation of the development sleeve 36 bearing developer thereon generates an air current by introducing the air in the rotational direction. Moreover, as described above, on a magnetic pole such as the development pole S1 and the conveyance pole N1, the developer forms a magnetic brush having a chain-shape structure along a magnetic line of force of each magnetic pole. The magnetic brush stands forward immediately before a magnetic pole, and the magnetic brush leans forward and falls after passing the magnetic pole. Herein, the magnetic brush is rotated in a direction the same as a rotational direction of the development sleeve 36, and a tip speed of the magnetic brush is higher than a rotation speed of the development sleeve 36. Moreover, in the magnetic brush state, a distance between toners is large and a maximum height of the magnetic brush is large. Hence, it is conceivable that a driving force for generating an air current in the region where the magnetic brush is formed on this pole is larger than a driving force in a region other than the magnetic brush region. Therefore, it is conceivable that an air current driving force on the development sleeve 36 is larger on the development pole S1 and the conveyance pole N1 and smaller between the development pole S1 and the conveyance pole N1 and between the conveyance pole N1 and the stripping pole S2.

The rotation of the development sleeve 36 causes the air to be taken into the developer container 25 from the intake portion 40. The air current which has passed the conveyance pole N1 flows together with the developer borne on the development sleeve 36 to the stripping pole S2. However, in the stripping pole S2, the stripping retention portion is formed by the developer. In the stripping retention portion, as described above, a flow speed of the developer on the development sleeve 36 is lowered, and the developer is retained. Hence, the stripping retention portion is in a state in which a maximum retention amount of the developer is steadily borne. The stripping retention portion becomes an obstacle for the air current in the vicinity of the development sleeve 36. The air current which has impinged on the stripping retention portion as the obstacle flows along the stripping retention portion, and is separated from the vicinity of the development sleeve 36.

An air current after flowing along the stripping retention portion and being separated from the vicinity of the development sleeve 36 is forecasted. Since the air is fluid, an equation of continuity can be applied. Since no air is generated inside the development chamber 27, the air current can be expressed by Equation (1) below.

$$\frac{\partial p}{\partial t} + \nabla \cdot \rho v = 0 \tag{1}$$

In Equation (1), where p is an internal pressure of the developer container 25, v is a flow speed of the air, and p is a density of the air.

Given that the air flows in from the intake portion 40, the internal pressure p gradually increases. The increase in the internal pressure p is moderated with time, and the internal pressure p enters a steady state. Given that the steady state is provided, a density ρ is constant in each region inside the development chamber 27. Accordingly, the aforementioned Equation (1) can be written as Equation (2) below.

$$\rho \nabla \cdot v = 0 \tag{2}$$

Equation (2) indicates that a flow volume ρv of the air is stored. Moreover, the balance of an air flow volume ρv is zero on the assumption that enclosed space is provided. The development device 9Y may be substantially enclosed in a transverse cross-section of the development device 9Y as illustrated in FIG. 4, and the intake portion 40 is the only opening. In such a case, since the balance of the flow volume ρv is zero, the volume of an air current which is substantially the same as the volume of an air current flowing in from the intake portion 40 is generated from the intake portion 40 to the outside in an equilibrium state. Since driving of the air current is the development sleeve 36 and the developer to be conveyed by the development sleeve 36, an air current 1 that flows into the developer container 25 is generated on a side closer to the development sleeve 36 in the intake portion 40, and an air current 2 that is discharged from the developer container is generated on a side farther from the development sleeve 36 in the intake portion 40.

<Toner Scattering>

Next, toner scattering is described. With triboelectric charge, toner adheres to carrier by an electrostatic adhesion force and a non-electrostatic adhesion force of a surface as described above. However, in a case where strong impact or a shearing force is applied, the impact or the shearing force exceeds the electrostatic adhesion force and the non-electrostatic adhesion force. In such a case, the toner is released from the carrier. Herein, there are broadly two types of toner release locations. One is the outside of an opening of the developer container 25, and the other is the inside of the developer container 25. The former locations include an area in which a flow volume on the development sleeve 36 is regulated by the cut pole N2 of the development sleeve 36 and the development blade 39, and an area in which a magnetic brush falls on a magnetic pole out of developer behaviors on the development sleeve 36. The toner released in such a location scatters. Accordingly, a method for preventing the toner from scattering by sealing the area with a sealing member such as Mylar (polyethylene terephthalate (PET) film) is taken as a countermeasure to deal with such toner scattering. The latter locations include an area in which developer is agitated and conveyed by the first and second conveyance screws 30 and 31 inside the developer container 25, and an area in which a stripping retention portion is formed by the stripping pole S2 of the development sleeve 36. The toner scattered inside the developer container 25 is conveyed by the air current 2 discharged from the inside of the developer container 25 to the outside of the development device 9Y, and then scatters.

The scattered toner discharged from the developer container 25 soils the inside of the image forming apparatus, and exerts various influences. An exposure process and a transfer process before or after the development process tend to be affected. Particularly, in the primary transfer portion, the toner scattering causes a stain on the intermediate transfer belt 11. Moreover, if toner stains are accumulated, a toner lump can be formed, for example, on the intermediate transfer belt 11 and an end portion of the primary transfer roller 16Y. In a case where the scattered toner adheres to the back of the intermediate transfer belt 11, a stain is formed on a drive roller, and a drive failure occurs. These result in quality degradation such as streaks and fogging in a printed image as a product. The toner scattering also soils the development device 9Y. This causes a stain problem when the development device 9Y is replaced, and the development device 9Y needs to be cleaned or adjusted.

<Scattering Prevention Electrode>

Figure 5:
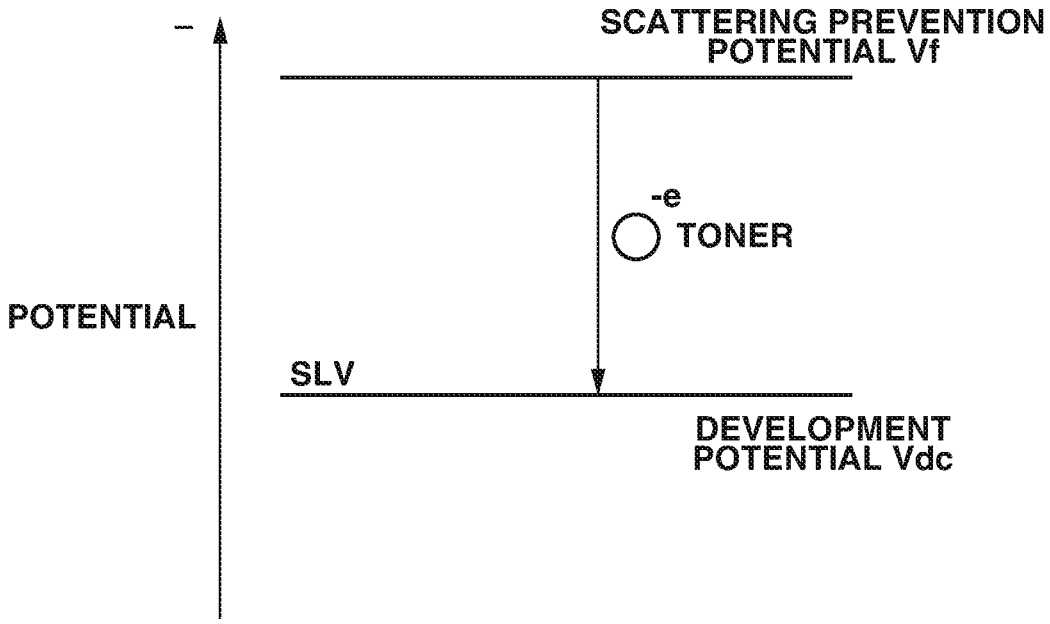
FIG. 5 is a diagram illustrating a scattering prevention voltage, according to one or more embodiment(s) of the subject disclosure.

The development device according to the present exemplary embodiment includes a scattering prevention electrode 50 to solve a problem due to scattering of toner from the inside of the development device 9Y in association with air discharge from the intake portion 40. As illustrated in FIG. 5, the scattering prevention electrode 50 applies a scattering prevention voltage Vf having the same polarity as a polarity of a toner charge to the development sleeve 36, and presses the scattered toner toward the development sleeve 36, thereby obtaining an electric field filter effect.

As illustrated in FIG. 3, the scattering prevention electrode 50 is a conductive electrode, and is arranged on an opposite side of the development blade 39 with an area where closest portion between the development sleeve (developer bearing member) 36 and the photosensitive drum 6Y comes closest to each other therebetween. Moreover, the scattering prevention electrode 50 is arranged in the developer container 25 so as to extend in a longitudinal direction of the developer container 25 and to face the conveyance pole N1 in the intake portion 40. A voltage having the same polarity as a normal charge polarity of toner is applied to the scattering prevention electrode 50 such that the scattering prevention electrode 50 has a higher voltage in terms of an absolute value than the development sleeve 36 to which a development voltage is applied.

As a result, a potential difference is generated in a direction of the development sleeve 36 from the scattering prevention electrode 50 as viewed from toner. With an action of the potential difference, the toner to be discharged from the inside of the developer container 25 by the air current 2 is pressed toward the development sleeve 36 and merges with the air current 1 in the intake portion 40, thereby returning to the inside of the developer container 25. Since the developer passes the intake portion 40 as described above, a surface of the scattering prevention electrode 50 is insulated such that the carrier is not energized or leaked.

<Power Source Configuration of Scattering Prevention Electrode>

Figure 6:
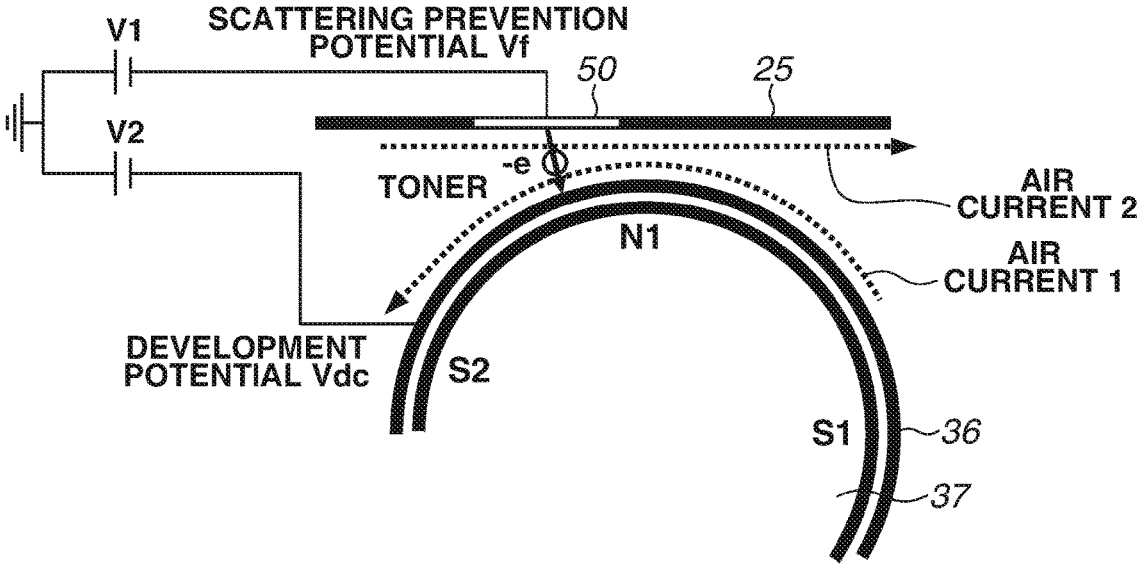
FIG. 6 is a schematic diagram illustrating a configuration of a scattering prevention electrode in a comparative example, with respect to one or more embodiment(s) of the subject disclosure.

In a case where the scattering prevention electrode 50 is used, there is an issue. A power source V2 dedicated to the scattering prevention electrode 50 needs to be provided as illustrated in FIG. 6, for example. The arrangement of the power source V2 separately from a development voltage power source V1 causes an increase in the cost or size of the image forming apparatus.

Figure 7:
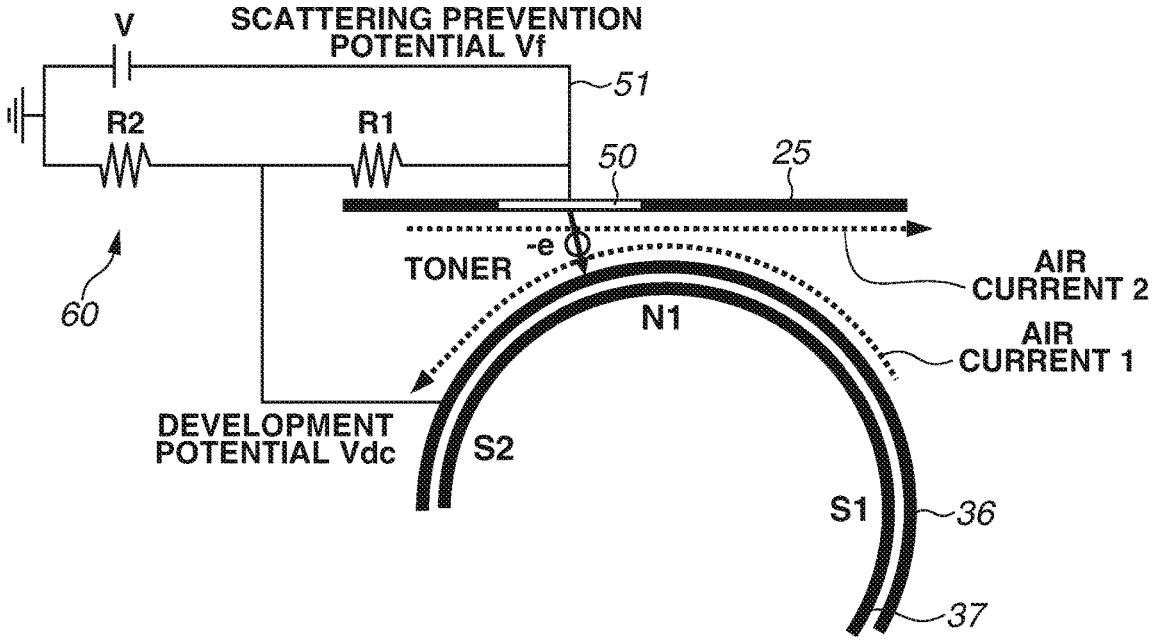
FIG. 7 is a schematic diagram illustrating a configuration of a scattering prevention electrode according to the first exemplary embodiment.

Accordingly, a power source unit of the present exemplary embodiment, as illustrated in FIGS. 3 and 7, includes a power source V as a direct current power source, and a step-down circuit 60 that steps down voltage from the power source V. The power source V can generate a toner scattering prevention voltage that is higher than a development voltage. The power source V is connected to a negative electrode via the scattering prevention electrode 50 and a wiring 51. Moreover, the step-down circuit 60 is provided in a branched wiring that diverges from the wiring 51 between the power source V and the scattering prevention electrode 50. The step-down circuit 60 includes a first resistor R1 and a second resistor R2 that are connected in series. An end portion of the first resistor R1 is connected to the power source V such that voltage is input, whereas an end portion of the second resistor R2 is connected to a ground. A wiring provided the development sleeve 36 between the first resistor R1 and the second resistor R2 is connected to such that the voltage stepped down by the first resistor R1 is applied as the aforementioned development voltage to the development sleeve 36.

Figure 8:
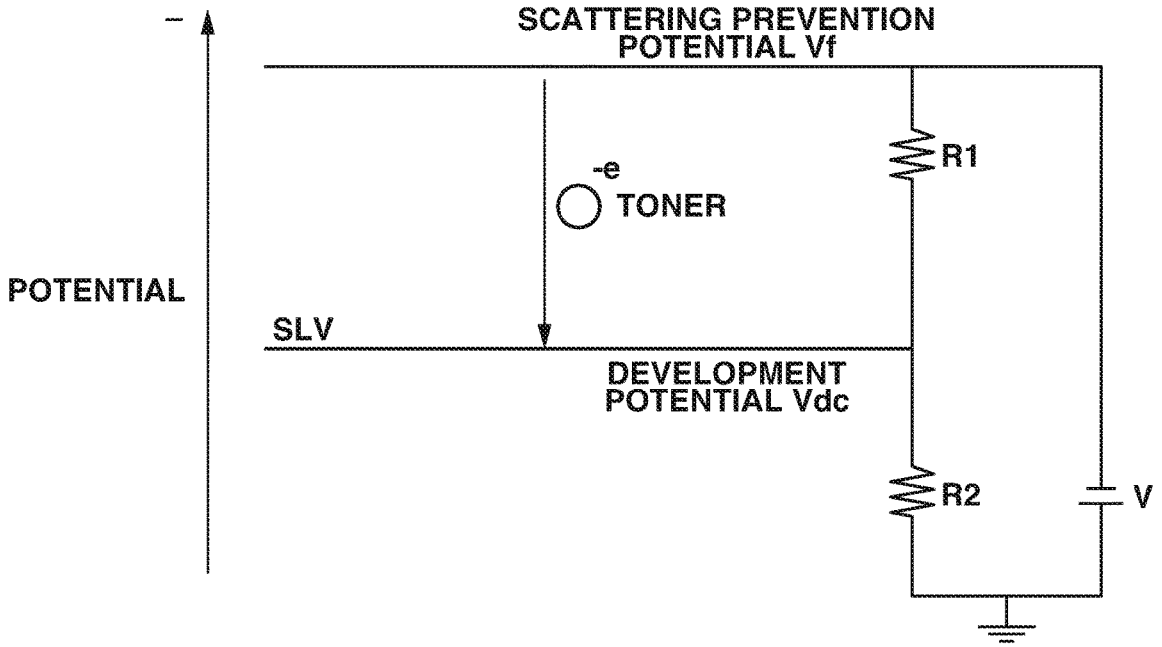
FIG. 8 is a schematic diagram illustrating a configuration of a power source unit according to the first exemplary embodiment.

That is, the step-down circuit 60 is configured such that voltage from the power source V is stepped down by the first resistor R1, and the stepped-down voltage is grounded via the second resistor R2 with respect to the wiring that has diverged from the development sleeve 36. That is, in the present exemplary embodiment, the step-down circuit 60 includes a voltage divider circuit that divides voltage from the power source V using the first resistor R1 and the second resistor R2. Therefore, as illustrated in FIG. 8, a scattering prevention voltage and a development voltage can be acquired without arrangement of a new power source, and the toner scattering can be prevented. The term "step-down" used in the present exemplary embodiment represents reduction in a potential difference if a voltage value is considered in terms of an absolute value. Particularly, a relation between a voltage supplied from the power source V, a development voltage, and a scattering prevention voltage is expressed as Equation (3) and Equation (4).

$$V_{dc} = \frac{R2}{R1 + R2} \times V \tag{3}$$

$$V_f = \frac{R1}{R1 + R2} \times V \tag{4}$$

In Equation (3) and Equation (4), where V is a voltage to be applied from the power source V, Vdc is a development voltage, and Vf is a scattering prevention voltage (a potential difference between the development sleeve 36 and the scattering prevention electrode 50).

Accordingly, a ratio of the first resistor R1 for step-down to the second resistor R2 is determined by necessary voltages of the development voltage Vdc and the scattering prevention voltage Vf. The development voltage Vdc is determined based on an experiment executed beforehand according to installation environment of the image forming apparatus, and applies a voltage of approximately −200V to approximately −600V.

Herein, a condition for which the scattering prevention voltage Vf presses toner toward the development sleeve 36 from the air current 2 is considered. If toner moves from the developer container 25 side to the development sleeve 36 side in time for which toner passes a width of the scattering prevention electrode 50, a condition of Equation (5) needs to be satisfied.

$$d > \frac{1}{2}\frac{qV_f}{dm} \times \left(\frac{V}{D}\right)^2 \tag{5}$$

In Equation (5) and the following description, d is a distance between the development sleeve 36 and the developer container 25 in the intake portion 40, D is a width of the scattering prevention electrode 50, q is an electric charge of toner, v is a speed of toner discharged with an air current, and m is a weight of toner. Accordingly, the scattering prevention voltage Vf needs to satisfy Equation (6).

$$V_f > 2\frac{m}{q}\frac{d^2D^2}{v^2} \tag{6}$$

For example, if an amount of electric charge of toner is −20 μC/g, a speed v is 500 mm/s based on assumption that the speed v is substantially equal to a speed of the development sleeve 36 at a maximum according to the relation of the flow volume, a distance d is 2 mm, and a width D is 4 mm, a scattering prevention voltage Vf can be approximately 160 V or more. Such a numeric value includes a container configuration such as the distance d between the development sleeve 36 and the developer container 25 in the intake portion 40 and the width D of the scattering prevention electrode 50, and a setting value such as a rotation speed of the development sleeve 36, the toner scattering can be prevented by application of a voltage by which a potential difference between the development sleeve 36 and the scattering prevention electrode 50 is 100 V or more. Since a ratio of the resistor R1 to the resistor R2 can be determined using a condition at the time when a development voltage is small, R1:R2 can be set to 1:2 when a development voltage is −200 V. In such a case, an application voltage V from a power source is applied so as to satisfy a relation of Equation (7) with respect to a target development voltage Vdc, so that a scattering prevention voltage Vf can be maintained at 100 V or more in each environment.

$$V = \frac{R1 + R2}{R1} V_{dc} \tag{7}$$

In general, since application of high voltage to the development device 9Y and driving of the development device 9Y are performed on a rear side of the apparatus, arrangement of a resistor in a position on the rear side of the apparatus may be difficult. In the present exemplary embodiment, the scattering prevention electrode 50 extending in a longitudinal direction is served as a wiring, and the first resistor R1 is arranged on a front side of the apparatus. With such arrangement, a development voltage is applied to the development sleeve 36. That is, in the present exemplary embodiment, the scattering prevention electrode 50 is arranged along an axial direction of the development sleeve 36, and also serves as a wiring of the step-down circuit 60.

<Verification Experiment>

Next, a result of verification experiments on the above-described development device is described. In the verification experiments, an image RUNNER ADVANCE C5255 manufactured by Canon Inc., was remodeled and used as an image forming apparatus. Since the image RUNNER ADVANCE C5255 is already in the market, a description of a basic configuration thereof is omitted. A description is mainly given of remodeled portions. Specifically, a resistor R1 having a high voltage resistance of 500 MΩ and a resistor R2 having a high voltage resistance of 1000 MΩ were added to a development device as a configuration corresponding to the present exemplary embodiment.

Figure 9:
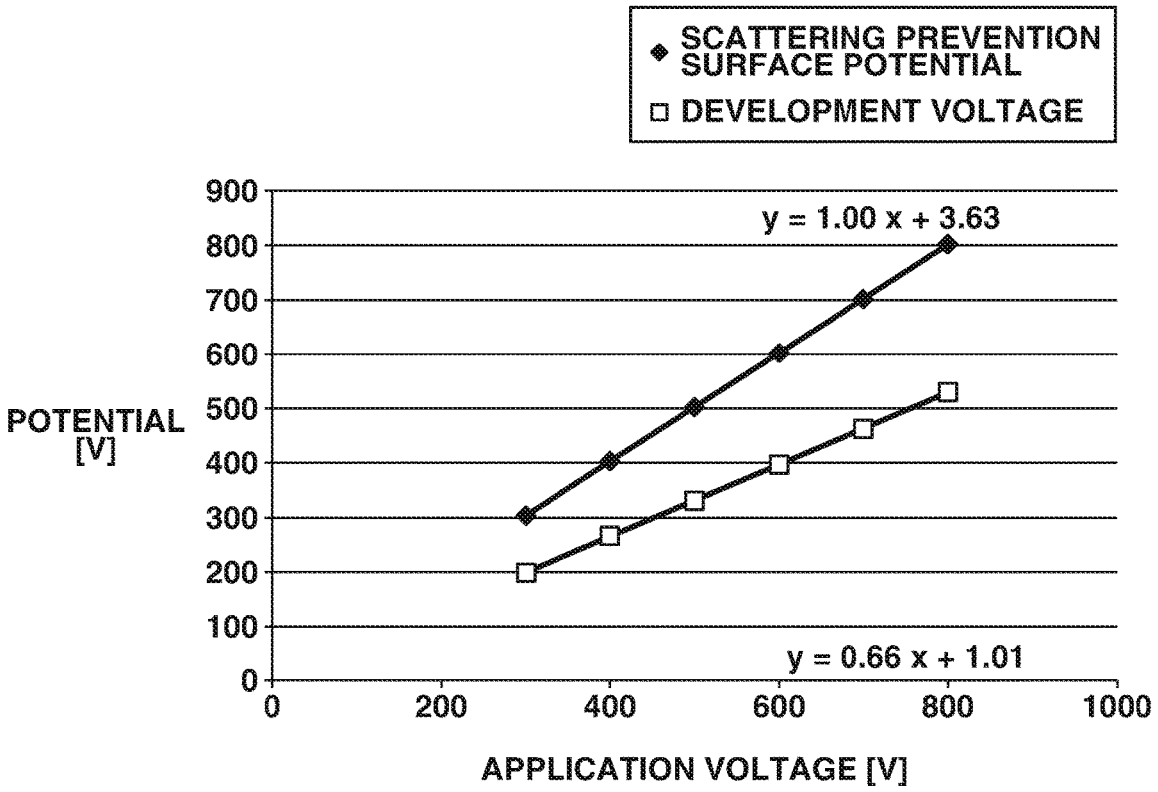
FIG. 9 is a diagram illustrating a relation between the scattering prevention voltage and a scattering prevention surface potential, according to one or more embodiment(s) of the subject disclosure.

First, a relation between a surface potential of a scattering prevention electrode and a development voltage at the time of application of a voltage V was examined as a starting experiment. FIG. 9 illustrates a result of the experiment. According to the result, the surface potential of the scattering prevention electrode and the development voltage were linear with respect to an application voltage from an external power source, and a minimum potential difference of 100 V was maintained. Hence, it was determined that the development device was usable.

Moreover, after 10,000 sheets were output in a testing laboratory under the environment with a temperature of 23° C. and a humidity of 50%, items below were compared in a sensorial manner. The results obtained from the experiments are illustrated in FIG. 10.

(1) stain on an output image
(2) stain on a development device
(3) stain on a transfer unit
(4) stain on an exposure unit The configuration of the comparative example using the dedicated power source illustrated in FIG. 6 and the configuration of the present exemplary embodiment were compared with respect to the above-listed items, and evaluation results were substantially equal to each other. That is, it is conceivable that toner scattering can be prevented by the configuration of the present exemplary embodiment without a cost of the dedicated power source as equally as possible by the configuration of the comparative example.

In particular, a direct current voltage and an alternating current voltage may be superimposed on a development voltage. In such a case, an alternating current can be rectified to a direct current by a rectification device, and the rectified direct current voltage can be applied for the scattering prevention electrode so that a development voltage power source is served as an electrode for the scattering prevention electrode. According to the configuration of the present exemplary embodiment, however, in the development device using a development voltage on which an alternating current voltage is not superimposed, a power source has a higher voltage than the development voltage at the time of a voltage input to secure a direct current potential having a higher voltage than the development voltage (a potential difference is large in a predetermined potential direction (in a negative potential direction in the present exemplary embodiment)) inside the development device. Moreover, a voltage is stepped down using the resistor to use the stepped-down voltage for a development voltage. Thus, a voltage higher than the development voltage can be obtained without a new power source.

That is, according to the configuration of the present exemplary embodiment, the power source V is configured such that a second voltage the absolute value of which is larger than an absolute value of a first voltage (e.g., a development voltage) to be applied to the development sleeve 36 can be applied. Moreover, the configuration of the present exemplary embodiment includes the step-down circuit 60 which steps down a voltage from the power source V from the second voltage to the first voltage, and applies the stepped-down voltage to the development sleeve 36. The first voltage prior to the step-down by the step-down circuit 60 is applied to the scattering prevention electrode 50, whereas the second voltage stepped down by the step-down circuit 60 is applied to the development sleeve 36. Therefore, the toner scattering can be prevented, an increase in costs can be suppressed using the power source V for dual purpose, and the inside of the image forming apparatus can be prevented from being soiled with toner. Moreover, since the toner soiling is reduced, maintenance frequency can be reduced.

A second exemplary embodiment is described below. The second exemplary embodiment differs from the first exemplary embodiment in that a toner scattering voltage is applied to a development blade 39 as well. Hereinafter, components that differ from the first exemplary embodiment are only described.

Figure 11:
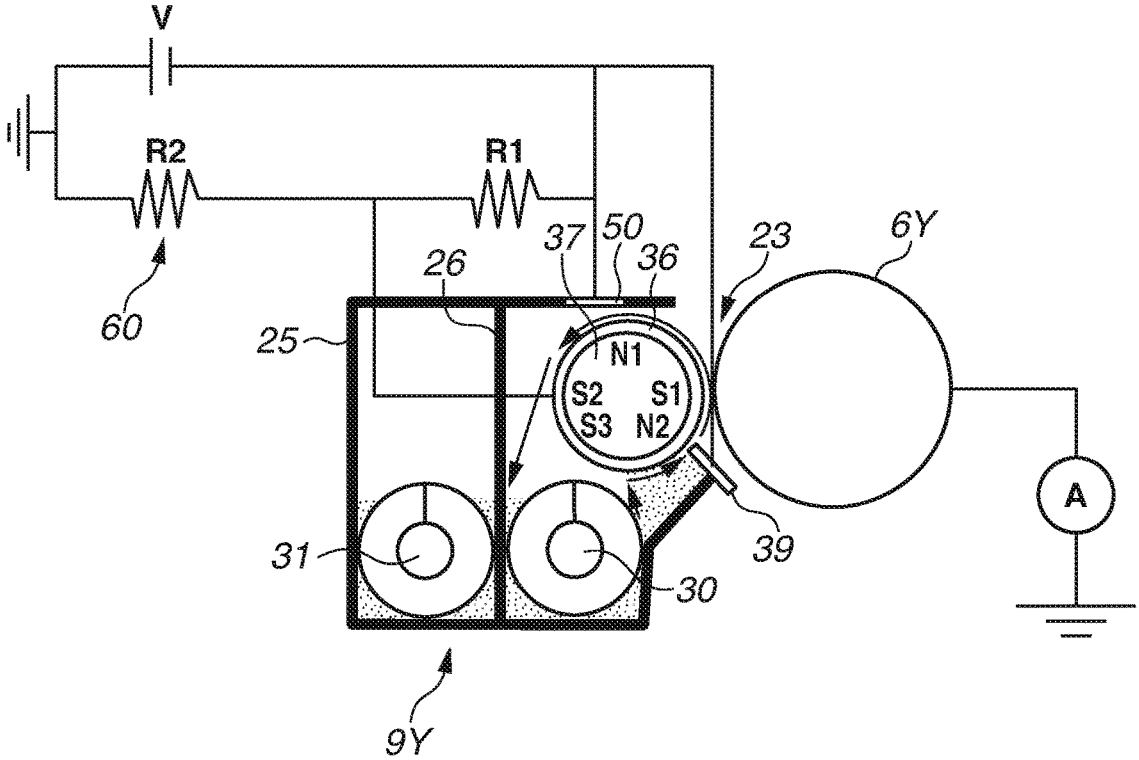
FIG. 11 is a sectional view illustrating a development device according to a second exemplary embodiment.
Figure 12:
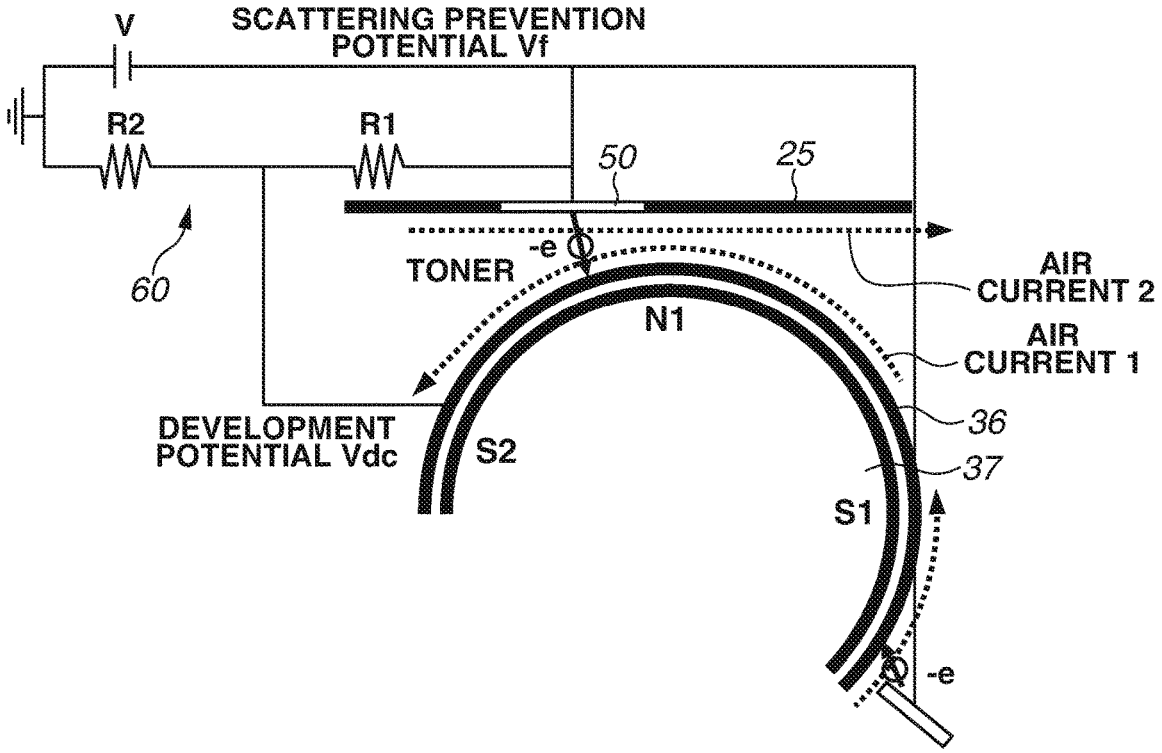
FIG. 12 is a schematic diagram illustrating a configuration of a scattering prevention electrode according to the second exemplary embodiment.

As illustrated in FIGS. 11 and 12, a development device according to the second exemplary embodiment applies a scattering prevention voltage to a development blade 39 by using a wiring that diverges on a side of a power source V relative to a first resistor R1. That is, in the present exemplary embodiment, a second voltage higher than a first voltage to be applied to a development sleeve 36 is also applied to the development blade 39 as a layer thickness regulation member from the power source V. The development blade 39 regulates a layer thickness of developer borne on the development sleeve 36. As described above, although toner is scattered from the inside of a development device 9Y, such toner scattering is not due solely to an air current of an intake portion 40. In a case where the developer regulated by the development blade 39 and borne on the development sleeve 36 is rotated, collision occurs among the developers. As a result, toner scattering occurs even on a downstream side of the development blade 39.

Since such toner scattering occurs on an upstream side of a development region 23 in a rotational direction of a photosensitive drum 6Y, an exposure process that is a preceding process of a development process tends to be affected. As described above, laser beams or LED light are used in the exposure process. In a case where an optical path for the laser beams or the LED light is soiled with toner due to the toner scattering, such soling causes extinction or diffraction of the light. Since the exposure process is performed such that an electrostatic latent image is formed according to an output image, a decrease in an amount of exposure light or diffraction of exposure light causes a failure to generate an electrostatic latent image. Thus, a method for stopping the toner scattering by sealing such an area with a sealing member such as Mylar is taken as a countermeasure to deal with the toner scattering. However, the use of only the method can cause toner accumulation. Consequently, the toner may spill depending on an endurance time, and the inside of the image forming apparatus may be soiled.

According to the present exemplary embodiment, a scattering prevention voltage is also applied to an upstream side of the development region 23 in a rotational direction of the photosensitive drum 6Y. More particularly, a scattering prevention voltage is also applied to the development blade 39. In a case where the development sleeve 36 has conductivity, the development blade 39 is formed using a resin member or a metal material that is insulated to prevent leakage of an electric current.

Similar to the first exemplary embodiment, comparisons were made in the present exemplary embodiment. After 10,000 sheets were output in a laboratory under the environment with a temperature of 23° C. and a humidity of 50%, items described below were compared in a sensorial manner. Moreover, the following item was added to the items evaluated in the first exemplary embodiment.

The results are illustrated in FIG. 10. As a result, evaluations of the items (1) through (3) in the second exemplary embodiment were substantially equal to those in the comparative example and the first exemplary embodiment. Moreover, an improved evaluation result was obtained as to the item (4). Therefore, it is conceivable that the present exemplary embodiment is also effective with respect to toner scattering on an upstream side of a development region.

A third exemplary embodiment is described below. The third exemplary embodiment differs from the first exemplary embodiment in that a first resistor R1' is a variable resistor. Hereinafter, a description is given of only points different from the first exemplary embodiment, and a description of other points is omitted.

Figure 13:
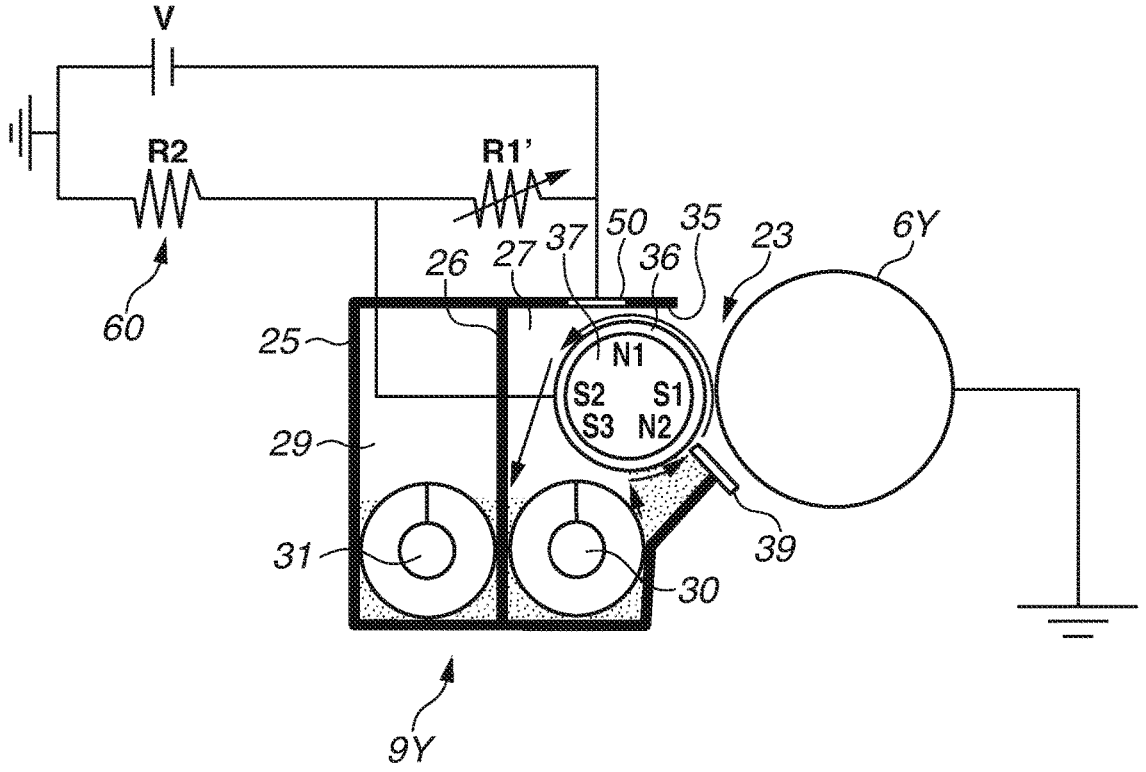
FIG. 13 is a sectional view illustrating a development device according to a third exemplary embodiment.

As illustrated in FIG. 13, the first resistor R1' in a step-down circuit 60 includes a variable resistance, and can change a resistance value according to usage of a development device. More particularly, a resistance value of the first resistor R1' is changed according to triboelectric charging performance of toner, and the resistance value is decreased to increase a development voltage if toner charging performance is high and an amount of electric charge of toner (hereinafter referred to as a triboelectric charge) is large. Moreover, the resistance value is increased to decrease a development voltage with degradation in the triboelectric charge of toner by degradation in toner charging performance.

In the present exemplary embodiment, therefore, a development device changes a development bias between a development sleeve and a scattering prevention electrode according to a triboelectric charge of toner. That is, the step-down circuit 60 includes the variable resistor R1', and a resistance is changed according to usage of the development device 9Y. Accordingly, the development device can prevent an increase in low triboelectrically charged toner on the development sleeve, that is referred to as underbrush, while effectively preventing toner scattering from the inside thereof. In the present exemplary embodiment, the first resistor is a variable resistor. However, a second resistor can be a variable resistor. Alternatively, both of the first and second resistors can be variable resistors.

OTHER EXEMPLARY EMBODIMENTS

In each of the above-described exemplary embodiments, the step-down circuit 60 includes the second resistor. However, the step-down circuit 60 can use, for example, a Zener diode instead of the second resistor. Moreover, a three-terminal regulator can be used as the step-down circuit 60. Moreover, a negative voltage is applied to the above-described scattering prevention electrode 50 and development sleeve 36. However, if toner is charged with a positive electric charge, a positive voltage is applied to the scattering prevention electrode and the development sleeve 36. In such a case, a voltage to be applied to the scattering prevention electrode 50 is higher than that to be applied to the development sleeve 36.

Moreover, each of the above exemplary embodiments has been described using an example in which the exemplary embodiment is applied to a printer employing an intermediate transfer method. However, the exemplary embodiment is not limited thereto. For example, the exemplary embodiments can be applied to a printer employing a direct transfer method. Moreover, the exemplary embodiments can be applied to an image forming apparatus for forming an image by using an electrophotographic method. The image forming apparatus includes a copier, a printer, a facsimile machine, and a multifunctional peripheral having a plurality of copying, printing, and facsimile functions. Moreover, the above-described exemplary embodiments can be combined with each other.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus that is able to execute image formation, comprising:

an image bearing member;

a developing device including:

a developer container configured to accommodate the developer including a toner and a carrier;

a rotatable developing member configured to carry and feed the developer toward a position where an electrostatic image formed onto the image bearing member is developed;

a magnet fixedly arranged inside the rotatable developing member, including a plurality of magnetic poles, and configured to generate a magnetic field for separating the developer that has passed the position where the electrostatic image formed onto the image bearing member is developed from an outer circumferential surface of the rotatable developing member, the plurality of magnetic poles including:

a first magnetic pole arranged closest to the position where the electrostatic image formed onto the image bearing member is developed, a second magnetic pole arranged downstream of the first magnetic pole with respect to a rotational direction of the rotatable developing member, a third magnetic pole arranged upstream of the first magnetic pole and downstream of the second magnetic pole with respect to the rotational direction of the rotatable developing member so as to be adjacent to the second magnetic pole, and having a same polarity as the second magnetic pole, and a plate-like electrode stationary attached to the developer container, the plate-like electrode arranged downstream of the position where the electrostatic image formed onto the image bearing member is developed and upstream of the second magnetic pole with respect to the rotational direction of the rotatable developing member so as to face the outer circumferential surface of the rotatable developing member;

wherein, during the image formation, only a first direct-current voltage is applied to the plate-like electrode and only a second direct-current voltage is applied to the rotatable developing member so that the first direct-current voltage applied to the plate-like electrode has a same polarity as a normal charge polarity of the toner, the second direct-current voltage applied to the rotatable developing member has a same polarity as the normal charge polarity of the toner, and an absolute value of the first direct-current voltage applied to the plate-like electrode is greater than an absolute value of the second direct-current voltage applied to the rotatable developing member.

2. The image forming apparatus according to claim 1, further comprising:

a common electric power source, wherein the common electric power source supplies electric power to apply the first direct-current voltage to the plate-like electrode, and supplies electric power to apply the first direct-current voltage to the rotatable developing member.

3. The image forming apparatus according to claim 2, further comprising:

an electric circuit in which the common electric power source, the plate-like electrode and the rotatable developing member are electrically connected in series, wherein the electric circuit having a first resistance member between the plate-like electrode and the rotatable developing member and a second resistance member between the rotatable developing member and a ground.

4. The image forming apparatus according to claim 3, wherein the first resistance member is a variable resistance capable of changing a resistance value.

5. The image forming apparatus according to claim 1, wherein the plate-like electrode is arranged along a rotational axis direction of the rotatable developing member, and wherein a length of the plate-like electrode in the rotational axis direction of the rotatable developing member is longer than a length of a region where the rotatable developing member is capable of carrying and feeding the developer in the rotational axis direction of the rotatable developing member.

6. The image forming apparatus according to claim 5, wherein a plurality of groove portions is arranged on the outer circumferential surface of the rotatable developing member along the rotational axis direction of the rotatable developing member, the plurality of groove portions being formed entirely on the outer circumferential surface of the rotatable developing member in the rotational direction of the rotatable developing member and being arranged having a predetermined interval therebetween in the rotational direction of the rotatable developing member, and wherein the region where the rotatable developing member is capable of carrying and feeding developer is a region where the plurality of groove portions is arranged in the rotatable developing member.

7. The image forming apparatus according to claim 1, wherein a surface of the plate-like electrode is insulated.

* * * * *